US005179404A

United States Patent [19]

Bartell et al.

[11] Patent Number: 5,179,404

[45] Date of Patent: Jan. 12, 1993

[54] ANTI-WEB ADHERING CONTOUR SURFACE FOR A PHOTOGRAPHIC PROCESSING APPARATUS

[75] Inventors: Roger E. Bartell, Rochester; Ralph L. Piccinino, Jr., Rush; John H. Rosenburgh, Hilton, all of N.Y.; Anthony Earle, London, England; David L. Patton, Webster, N.Y.

[73] Assignee: Eastman Kodak Company, Rochester, N.Y.

[21] Appl. No.: 844,343

[22] Filed: Mar. 2, 1992

[51] Int. Cl.[5] ..... G03D 3/08

[52] U.S. Cl. ..... 354/320; 354/338; 354/336

[58] Field of Search ..... 354/301, 320, 321, 322, 354/323, 324, 319, 303, 338, 339, 340, 336; 134/64 R, 122 R

[56] References Cited

U.S. PATENT DOCUMENTS

| | | | |
|---|---|---|---|
| 3,753,393 | 8/1973 | Niesen et al. | 354/339 |
| 4,099,194 | 7/1978 | Kümmerl | 354/321 |
| 4,291,969 | 9/1981 | Raymond | 354/322 |
| 4,345,832 | 8/1982 | Nomura et al. | 354/32.0 |
| 4,367,030 | 1/1983 | Raymond | 354/322 |
| 4,477,165 | 10/1984 | Spence et al. | 354/339 X |
| 4,511,231 | 4/1985 | Ashby | 354/301 |
| 4,534,635 | 8/1985 | Johnston et al. | 354/324 X |
| 4,647,173 | 3/1987 | Schär | 354/319 |
| 4,664,502 | 5/1987 | Fukushima et al. | 118/660 |
| 4,788,568 | 11/1988 | Ichikawa | 354/303 |
| 4,794,415 | 12/1988 | Larsen | 354/320 X |
| 4,945,934 | 8/1990 | Vaughan, IV | 134/64 R |
| 5,022,418 | 6/1991 | Vaughan, IV | 134/64 R |
| 5,032,871 | 7/1991 | Murata et al. | 354/338 X |
| 5,063,401 | 11/1991 | Oberkersch et al. | 354/320 |

*Primary Examiner*—Michael L. Gellner
*Assistant Examiner*—D. Rutledge
*Attorney, Agent, or Firm*—Ronald Reichman

[57] ABSTRACT

Textured surfaces on respective walls of racks and tanks of photographic processing apparatus reduce the frictional forces between the photosensitive material leading edge surfaces and the walls of the racks and tanks. The processing solution flows through fissures in the textured surfaces, thereby providing a solution bearing layer between the photosensitive material and the textured surfaces. This allows a greater photosensitive material leading edge impact angle with the textured walls which allows the photosensitive material to change direction unimpeded.

2 Claims, 7 Drawing Sheets

ANTI-WEB ADHERING CONTOUR SURFACE FOR A PHOTOGRAPHIC PROCESSING APPARATUS

CROSS REFERENCE TO RELATED APPLICATIONS

Reference is made to commonly assigned copending patent applications: Ser. No. 07/844,820 entitled "A DRIVING MECHANISM FOR A PHOTOGRAPHIC PROCESSING APPARATUS" filed herewith in the names of Ralph L. Piccinino, Jr., David L. Patton, Roger E. Bartell, Anthony Earle, and John Rosenburgh, Ser. No. 07/844,815 entitled "A RACK AND A TANK FOR A PHOTOGRAPHIC PROCESSING APPARATUS" filed herewith in the names of David L. Patton, Roger E. Bartell, John H. Rosenburgh and Ralph L. Piccinino, Jr., and Ser. No. 07/844,355 entitled "A SLOT IMPINGEMENT FOR A PHOTOGRAPHIC PROCESSING APPARATUS" filed herewith in the names of John Rosenburgh, David L. Patton, Ralph L. Piccinino, Jr., and Anthony Earle, Ser. No. 07/844,806 entitled "RECIRCULATION, REPLENISHMENT, REFRESH, RECHARGE AND BACKFLUSH FOR A PHOTOGRAPHIC PROCESSING APPARATUS" filed herewith in the names of Roger E. Bartell, David L. Patton, John Rosenburgh, and Ralph L. Piccinino, Jr.

BACKGROUND OF THE INVENTION

1. Field of the Invention

The invention relates to the field of photography, and particularly to a photosensitive material processing apparatus.

2. Description of the Prior Art

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art utilized various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

Activity degradation due to instability of the chemistry, or chemical contamination, after the components of the photographic solution are mixed together causes one to discard the photographic solution in smaller volume tanks more frequently than larger volume tanks. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

Rollers and guides are used in large volume photographic film processing apparatus to change the direction of travel of film and/or paper. A large volume processing apparatus has sufficient space to allow a gradual angular transition as the film or paper turns a corner, i.e. changes direction by 180°.

The prior art realized, that if the volume of the various tanks contained within various sizes of photographic processing apparatus were reduced, the same amount of film or photographic paper may be processed, while reducing the volume of photographic solution that was used and subsequently discarded. One of the problems encountered by the prior art in using smaller volume tanks was that the space was limited so that there was not sufficient space available to allow the rollers and guides utilized in the prior art to change the direction of travel of the film and/or paper.

In addition since the space is small in small volume tanks, the film and/or paper has to change direction at a more acute angle (than the angle used in large volume tanks) which makes it likely for the paper and/or film to jam between the walls of the tank and roller during the turning procedure. When the paper and/or film jammed, the processor would stop and time consuming maintenance procedures would have to be instituted. Furthermore, the images on the photosensitive material may be lost and may be nonreplaceable as the photosensitive material did not go through the proper processing sequence. This may cause tremendous customer dissatisfaction.

When the film and/or paper changed direction in a small volume tank, the film and/or paper were confined in a small area and naturally forced against the walls of the tank. The above was caused by: the stiffness of the film and/or paper; the force exerted by the processing solution on the surface of the photosensitive material; the change in frictional characteristics of hydroscopic material such as those found in the film and/or paper; and the surface characteristics of the photosensitive material.

In very confined spaces when guides such as fingers are used to aid in changing the direction of travel of the photosensitive material, pressure sensation marks, i.e., density lines may occur because of the introduction of the fingers and photosensitive material in the confined area.

SUMMARY OF THE INVENTION

This invention overcomes the disadvantages of the prior art by providing textured surface walls that reduces the frictional forces between the photosensitive material leading edge surfaces and the walls of low volume tanks. This is accomplished by allowing the processing solution to travel below the tank and rack walls through the fissures in the textured surface providing a fluid bearing between the paper or film surface and the textured surfaces. This allows a greater photosensitive material leading edge impact angle with the textured walls which allows the film and/or paper to change direction unimpeded.

The foregoing is accomplished by providing an apparatus for processing photosensitive materials, which comprises: a tank having an inner textured surface, configured so that if processing solution flows along the textured surface, the processing solution will move along the textured surface to create a solution bearing layer for photosensitive material to be moved over the textured surface; a rack having an outer textured surface, configured so that if processing solution flows along the textured surface, the processing solution will move along the textured surface to create a solution bearing layer for the photosensitive material to be moved over the textured surface, the rack has integral means to facilitate its insertion and removal from the tank and the rack and the tank are relatively dimensioned so that a small changing direction volume for holding photosensitive material and processing solution is formed between the rack and the tank; means for circulating the processing solution through the small volume; and means coupled to the rack for moving the photosensitive material through the small volume, whereby when the photosensitive material changes direction, the fluid bearing created by the textured surfaces on the rack and the tank allows the photosensitive material to change direction unimpeded.

DESCRIPTION OF THE PREFERRED EMBODIMENT

Figure 1:
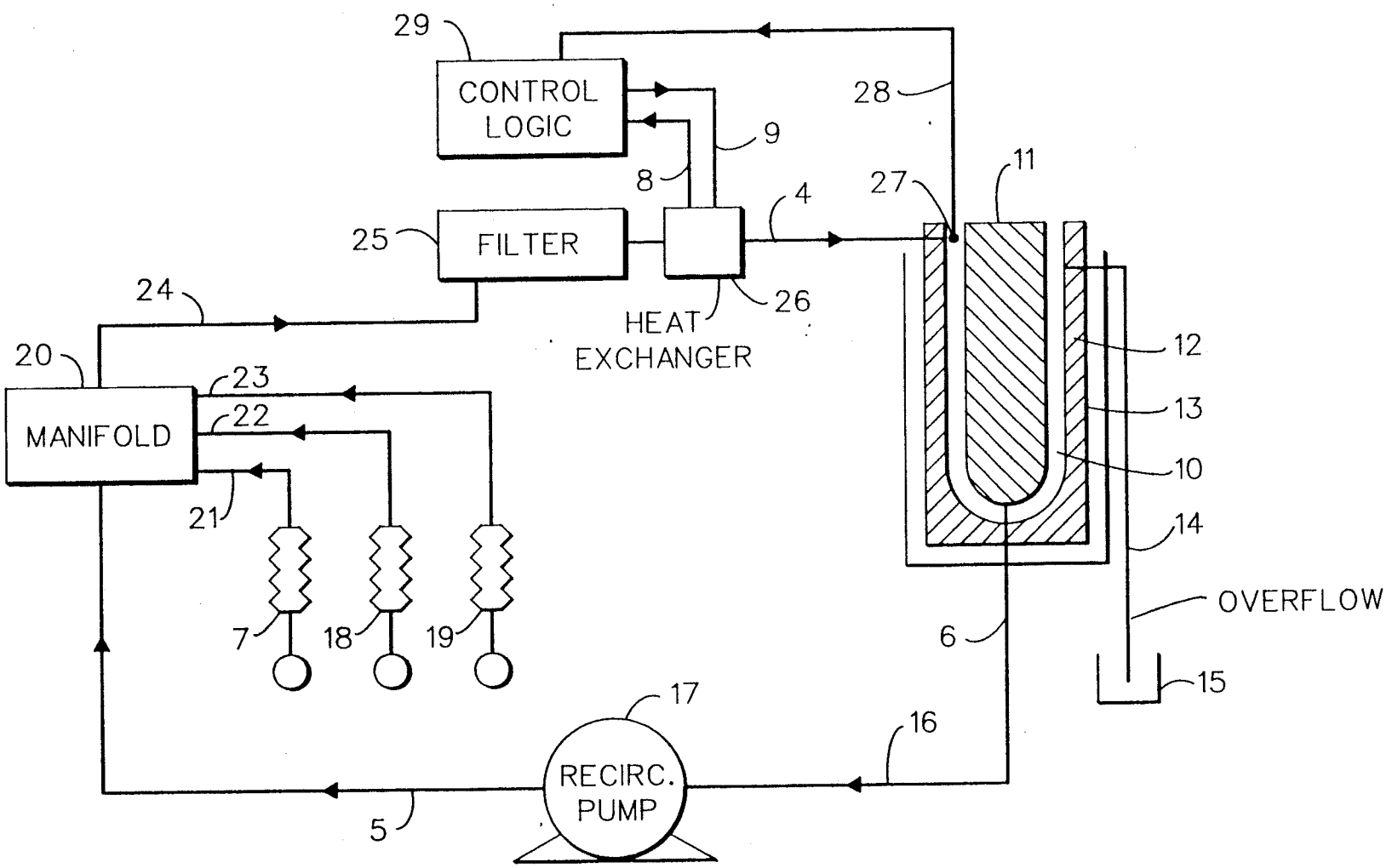
FIG. 1 is a schematic drawing of the apparatus of this invention.

Referring now to the drawings in detail, and more particularly to FIG. 1, the reference character 11 represents a rack 11, which may be easily inserted and removed from tank 12. Rack 11 and tank 12 form a low volume photosensitive material processing vessel 13.

When rack 11 is inserted in tank 12, a space 10 is formed. Rack 11 and tank 12 are designed in a manner to minimize the volume of space 10. The outlet 6 of vessel 13 is connected to recirculating pump 17 via conduit 16. Recirculating pump 17 is connected to manifold 20 via conduit 5 and manifold 20 is connected to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Metering pumps 7, 18 and 19 are respectively connected to manifold 20 via conduits 21, 22 and 23.

The photographic processing chemicals that comprise the photographic solution are placed in metering pumps 7, 18 and 19. Pumps 7, 18 and 19 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid state temperature controller manufactured by Omega Engineering, Inc. of 1 Omega Drive, Stamford, CT 06907. Logic 29 compares the solution temperature sensed by sensor 27 and the temperature that exchanger 26 transmitted to logic 29 via wire 8. Logic 29 will inform exchanger 26, via wire 9 to add or remove heat from the solution. Thus, logic 29 and heat exchanger 26 modify the temperature of the solution and maintain the solution temperature at the desired level.

At this point the solution enters vessel 13 via inlet 4. When vessel 13 contains too much solution the excess solution will be removed by drain 14 and flow into reservoir 15. The remaining solution will circulate through space 10 and reach outlet line 6. Thereupon, the solution will pass from outlet line 6 to conduit line 16 to recirculation pump 17. The photographic solution contained in the apparatus of this invention, when exposed to the photosensitive material, will reach a seasoned state more rapidly than prior art systems, because the volume of the photographic processing solution is less.

Figure 2:
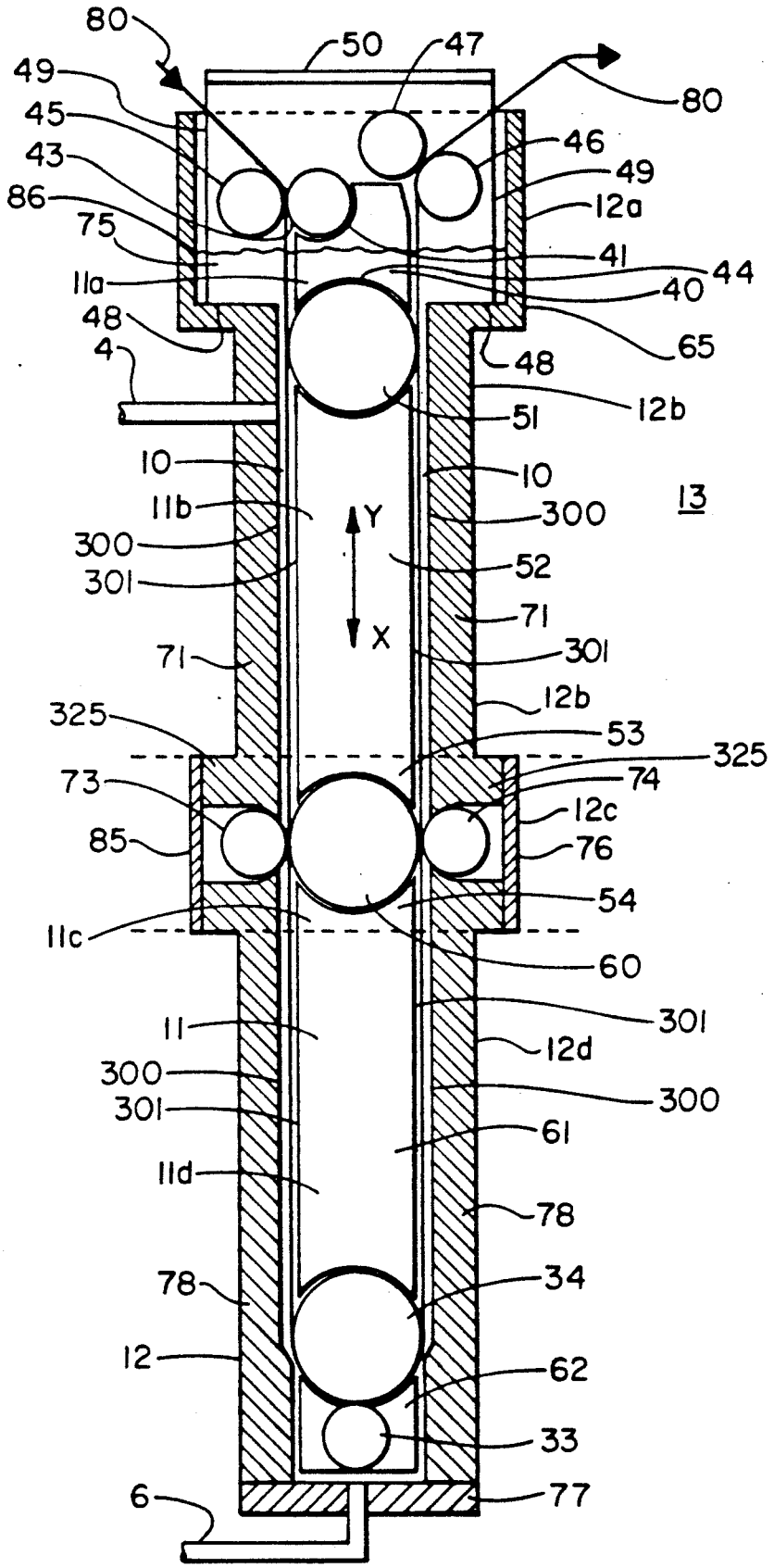
FIG. 2 is a schematic drawing showing rack 11 and tank 12 of FIG. 1 in greater detail.

FIG. 2 is a schematic diagram showing rack 11 positioned within tank 12. Handle section **11*a* of rack 11 includes a panel 40. Panel 40 has a cutout section 41 which allows driven roller 43 of rack section 11*a* to rotate in the vicinity of panel 40. Panel 40 also has a cutout section 44 which allows driving roller 51 of rack section 11*b* to rotate in the vicinity of panel 40. Driving roller 45 engages roller 43. Driving roller 46 drives driven roller 47. Rollers 46 and 47 are attached to section 11*a*. Bottom plate 48 is connected to panel 40 and side plates 49. Handle 50 is connected to side plates 49 so that an individual may be able to grasp handle 50 and move rack 11 in the direction indicated by arrow X, thereby inserting rack 11 into tank 12. This is the position shown in FIG. 2. Handle 50 may also be grasped and moved in the direction indicated by arrow Y to remove rack 11 from tank 12**.

Top section **11*b* of rack 11 includes panel 52 and driving roller 51 and center section 11*c* of rack 11 includes panels 53 and 54 and driving roller 60. Bottom section 11*d* of rack 11 includes panels 61 and 62, driving roller 34 and driven roller 33**.

Tank section **12*a* includes a housing section 65. Tank section 12*b* includes sides 71. Tank section 12*c* includes driven rollers 73 and 74 and sides 325. Roller 73 is connected to plate 85 and driven roller 74 is connected to plate 76. Plates 85 and 76 are connected to sides 325**.

Bottom section 12*d* of tank 12 includes bottom panel 77 and sides 78. Outlet conduit 6 passes through panel 77 and inlet conduit 4 passes through side 71.

Photosensitive material 80 may be a continuous web or cut sheets of film or photographic paper. The emulsion side of material 80 may face either rack 11 or tank 12. Material 80 passes in space 10 between rollers 45 and 43, roller 51, side 71, rollers 73, 60, 34, 33, 60, 74, and 51, side 71 and between rollers 46 and 47. Photographic processing solution 75 reaches a level 86 within tank 12. Photographic solution 75 will be contained in space 10 below level 86 in contact with photosensitive material 80. Thus, a small volume of photographic solution 75 will be on both sides of photosensitive material 80 between rack 11 and tank 12.

Rack 11 and tank 12 respectively comprise: handle sections 11*a* and 12*a;* to sections 11*b* and 12*b;* center sections 11*c* and 12*c*; and bottom sections 11*d* and 12*d*.

Tank 12 and rack 11 respectively have textured surfaces 300 and 301. The manner in which surfaces 300 and 301 function will be more fully set forth in the description of FIG. 7 and FIG. 8.

The length of rack 11 and tank 12 may be adjusted for different processing steps in the photographic process. If a vessel shorter than vessel 13 of FIG. 2 is required, center rack section 11*c* and center tank section 12*c* may be respectively deleted from rack 11 and tank 12. If a longer vessel than vessel 13 of FIG. 2 is required, one or more top sections 11*b* and 12*b* and one or more center sections 11*c* and 12*c* may be respectively connected between present sections 11*c* and 12*c* and present sections 11*d* and 12*d*.

Figure 3:
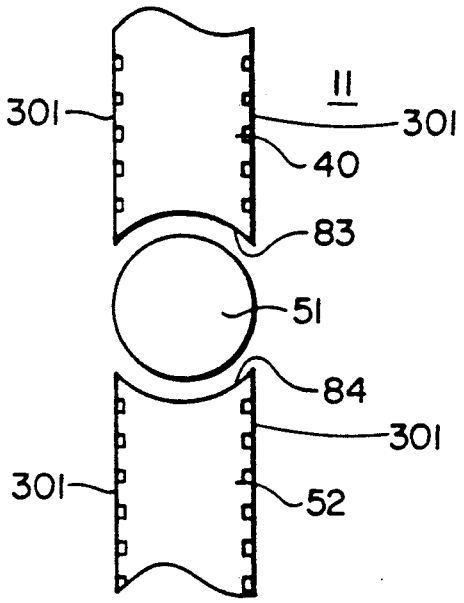
FIG. 3 is a drawing of a side view of driving roller 51 of FIG. 2.

FIG. 3 is a side view of roller 51 and textured surface 301 of rack 11. Rollers 60 and 34 are connected in a manner similar to the connection of roller 51 of FIG. 3.

Panels 40 and 52 of rack 11 respectively have curved portions 83 and 84. Portions 83 and 84 are shaped so that they will match the curvature of the outer surface of roller 51 and minimize the volume of solution 75 that will be contained between roller 51 and portions 83 and 84. Thus, the least amount of solution 75 is used to fill the voids around roller 51.

Figure 4:
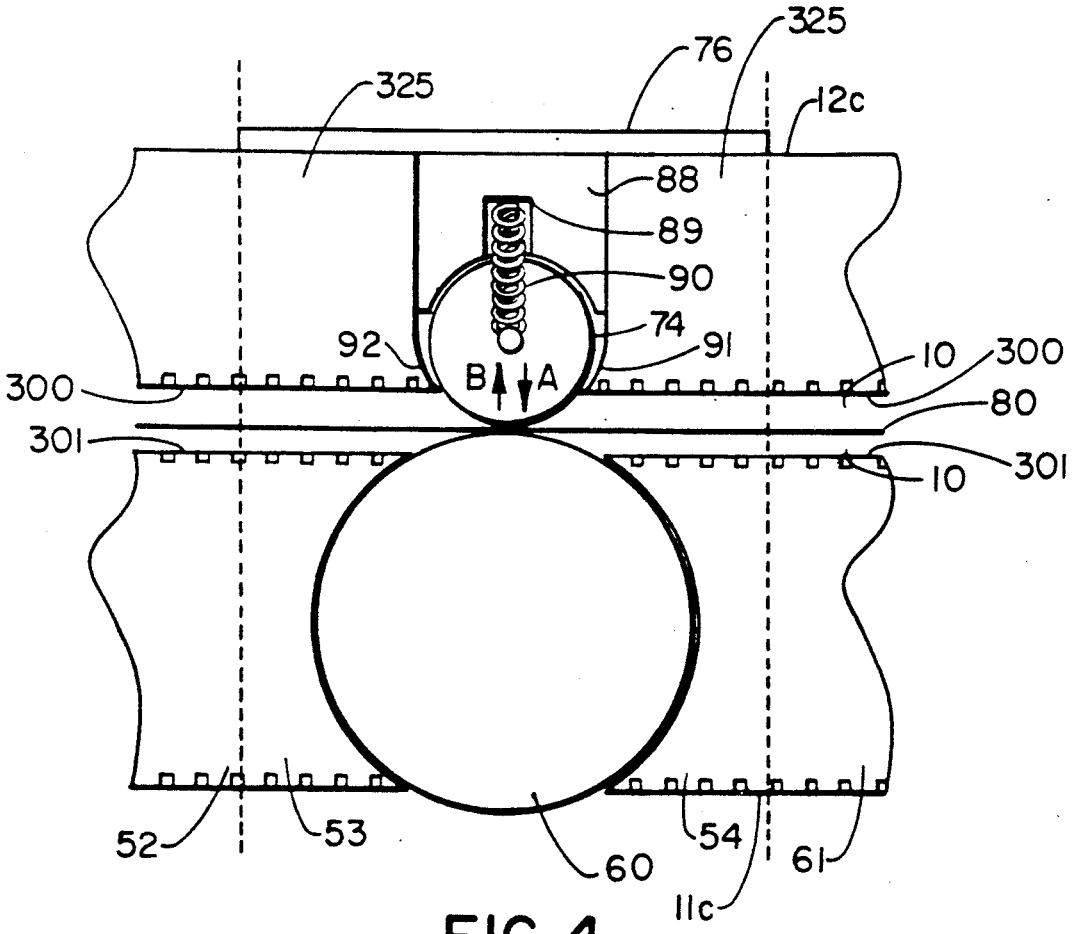
FIG. 4 is a drawing of a side view of driven roller 74 of FIG. 2.

FIG. 4 is a side view of roller 74 and roller 60 respectively of tank section 12*c* and rack section 11*c* of FIG. 2. Panel 53 and panel 54 with textured surface 301 are shaped so that they will match the curvature of the outer surface of roller 60 and minimize the volume of solution 75 that will be contained between the shaped portions of panels 53 and 54 and roller 60. Panel 52 with textured surface 301 butts against panel 53 and panel 61 with textured surface 301 butts against panel 54. Roller 73 of FIG. 2 is connected in the same manner as roller 74. Retainer 88 has a notch 89. One end of spring 90 is connected to notch 89 and the other end of spring 90 is connected to the hub of roller 74. One end of plate 91 is connected to retainer 88 and the other end of plate 91 is connected to textured surface 300. One end of plate 92 is connected to retainer 88 and the other end of plate 92 is connected to textured surface 300. Plates 91 and 92 are connected to retainer 88 and surface 300 in a manner to minimize the amount of surface contact roller 74 has with space 10. Retainer 88 is connected to back plate 76 by any known fastening means, i.e., bolts, screws, etc. Plate 76 is connected to side 325 (FIG. 2) of tank section 12*c* to minimize the volume of solution 75 that exists in the voids between the above surfaces, plates, rollers and tank. Photosensitive material 80 passes between rollers 60 and 74 so that driving roller 60 may move photosensitive material 80 in space 10 between textured surfaces 300 and 301. Roller 74 is spring loaded towards space 10 so that roller 74 may be compressed out of the way when rack 11 is inserted in tank 12.

Figure 4A:
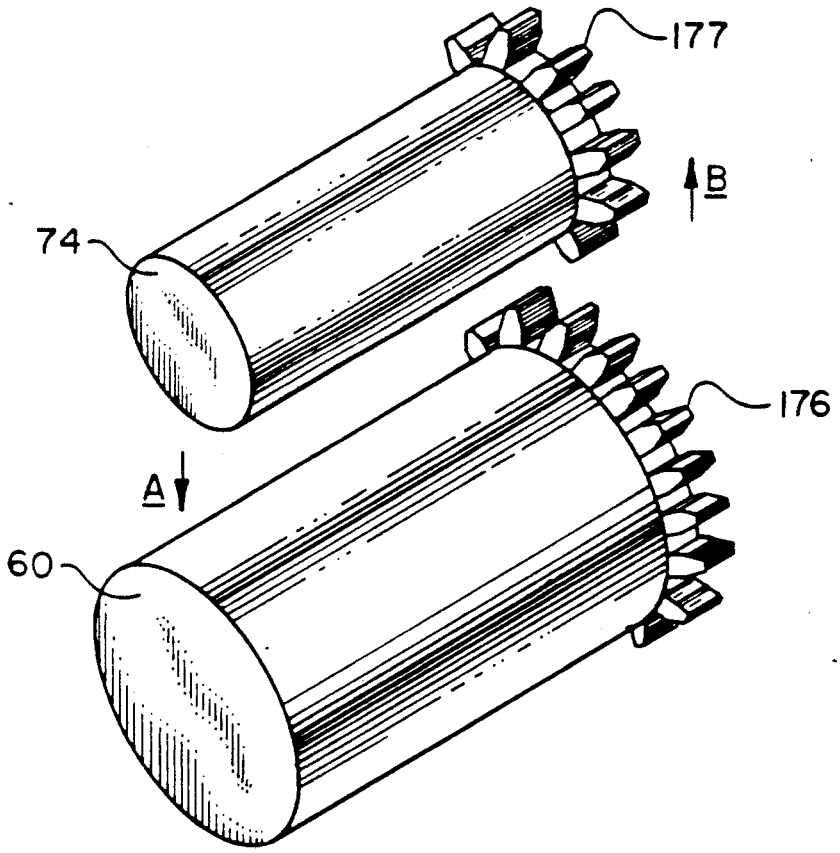
FIG. 4A is a drawing showing the gears of rollers 60 and 74.

FIG. 4A depicts gears 176 and 177 attached respectively to rollers 60 and 74 in such a manner that when roller 74 engages the surface of roller 60 gear 177 engages gear 176 so that gear 176 drives gear 177. When rack 11 is properly seated in tank 12, roller 74 will move in the direction shown by arrow A until it engages driving roller 60 and gears 176 and 177 will mesh. When rack 11 is removed from tank 12 roller 74 will move in the direction shown by arrow B compressing out of the way until rack 11 is removed from tank 12. At this juncture roller 74 will move in the direction shown by arrow A.

Figure 5:
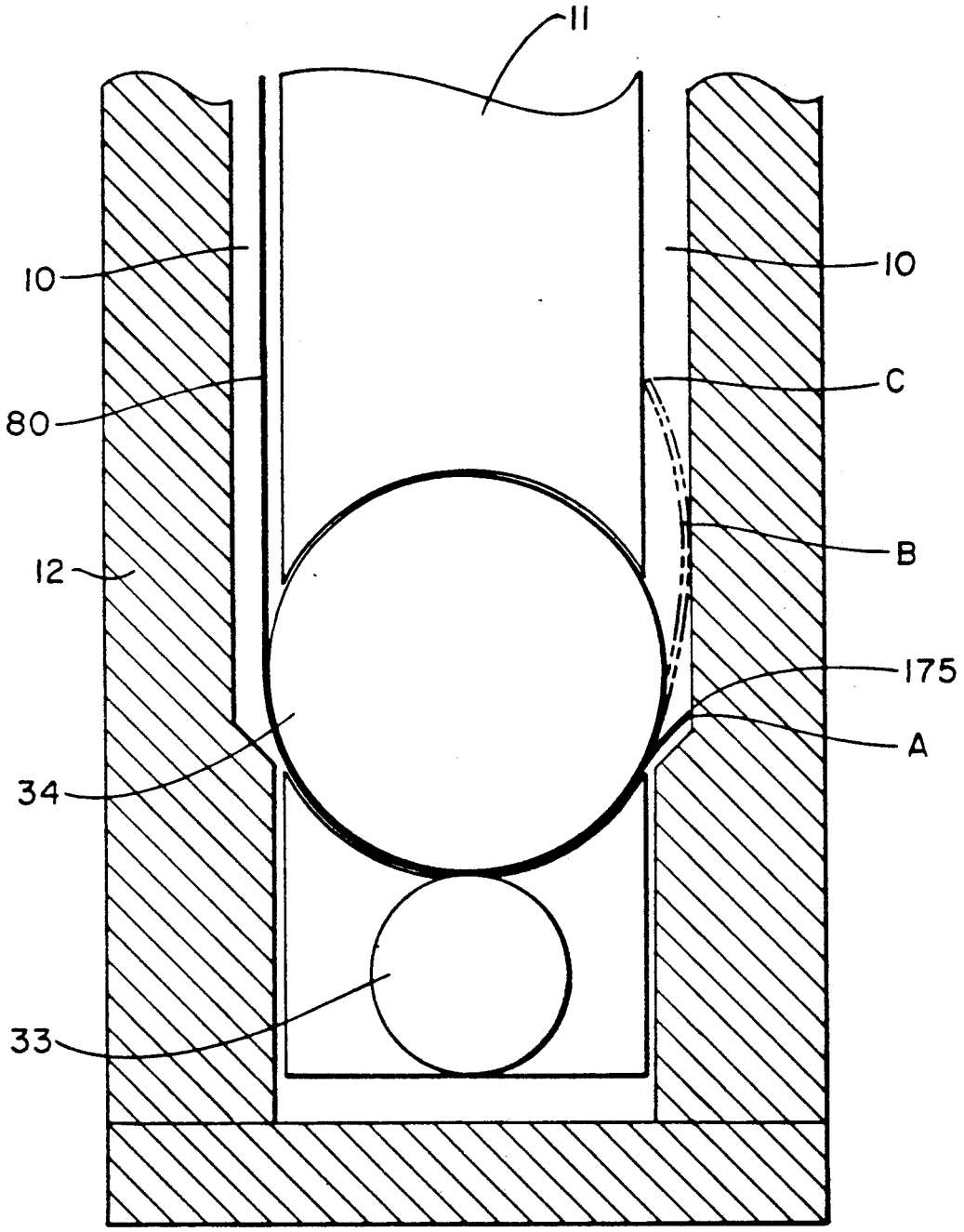
FIG. 5 is a drawing showing a photosensitive material changing direction in a small volume rack and tank that does not have textured walls.

FIG. 5 shows a photosensitive material 80 changing direction in rack 11 and tank 12 when the walls of rack 11 and tank 12 are not textured. Material 80 enters space 10 and passes between rollers 33 and 34. Since space 10 is narrow, leading edge 175 of material 80 may hit tank 12 at points A or B and rack 11 at point C and jam at the respective points necessitating time consuming maintenance procedures.

Figure 6:
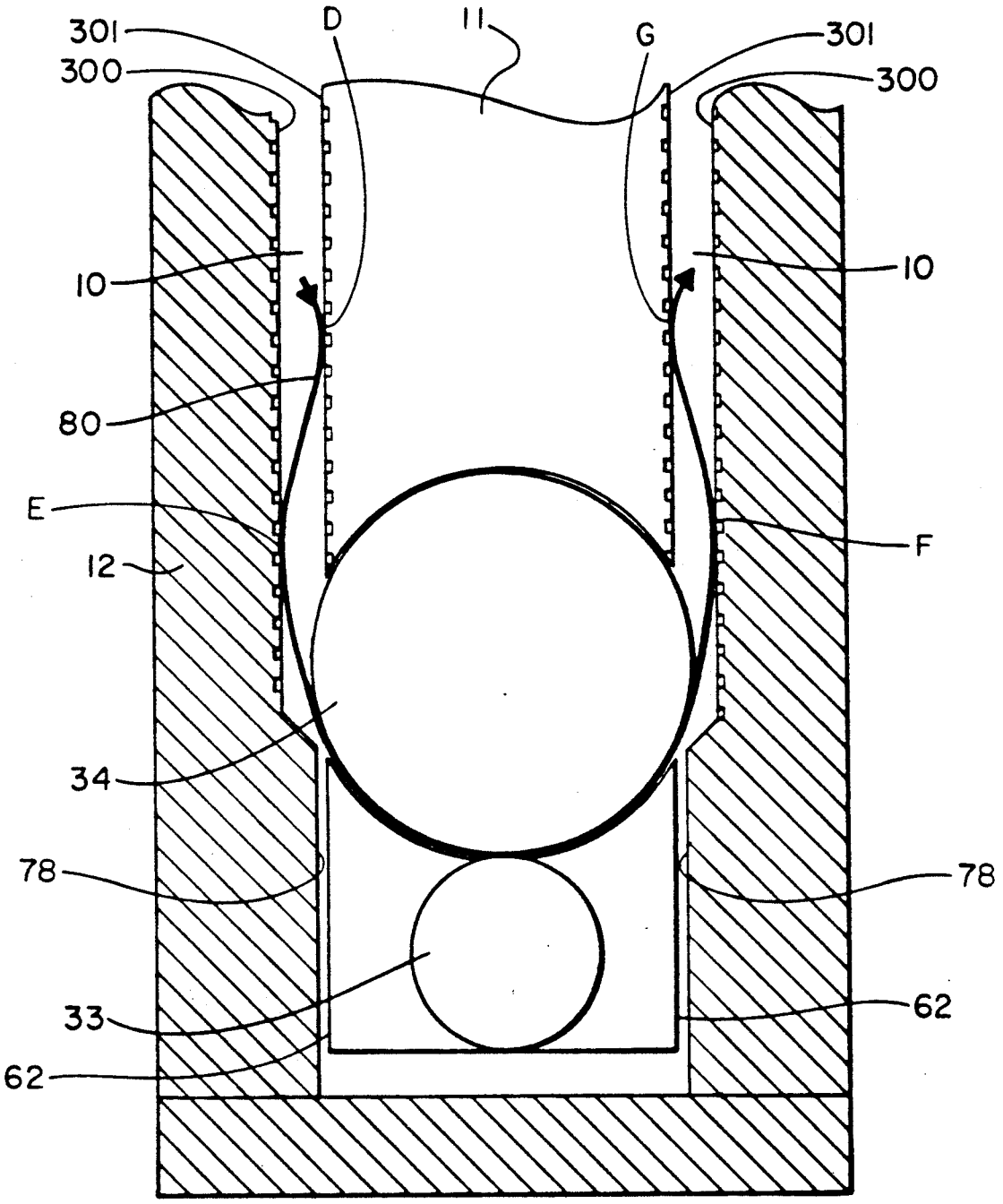
FIG. 6 is a drawing showing a photosensitive material changing direction in a small volume rack and tank that has textured walls.

FIG. 6 shows photosensitive material 80 changing direction in rack 11 and tank 12 when the walls of rack 11 and tank 12 are respectively textured with surfaces 301 and 300. Photosensitive material 80 enters space 10 and may strike textured fluid bearing surface 301 of rack 11 at point D. Material 80 continues to travel in space 10 and may strike textured fluid bearing surface 300 of tank 12 at point E. Material 80 continues to travel in space 10 and change direction between rollers 33 and 34. Thereupon, material 80 may strike textured surface 300 of tank 12 at Point F and climb up space 10. Then material 80 may strike textured surface 301 of rack 11 at point G, prior to exiting space 10. Thus, surfaces 301 and 300 permit material 80 to change direction without causing material 80 to jam.

Figure 7:
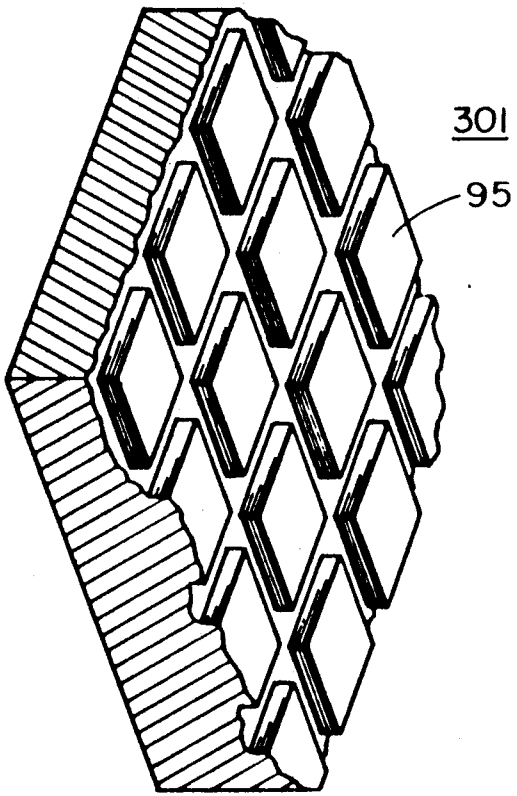
FIG. 7 is a perspective drawing of textured fluid bearing surface 301 which is affixed to rack 11 of FIG. 2.

FIG. 7 is a perspective drawing of textured fluid-bearing surface 301 which is affixed to rack 11 of FIG. 2. Textured surface 301 is textured by any known process, e.g., knurling, molded, EDM electro-discharged machined or applied. Knurls 95 are shown on surface 301. The texturing improves the flow of solution 75 between photosensitive material 80 and rack 11. This yields a bearing of fluid aiding photosensitive material transport through the rack arrangement and allows the gelatin on photosensitive material 80 to swell. It also allows for improved circulation of solution 75 and makes it easier for particulate matter to escape direct and damaging contact with photosensitive material 80. Textured surface 301 provides space between rack 11 and space 10 to prevent particulate matter from scratching, abrading or pressure sensitizing photosensitive material 80.

Figure 8:
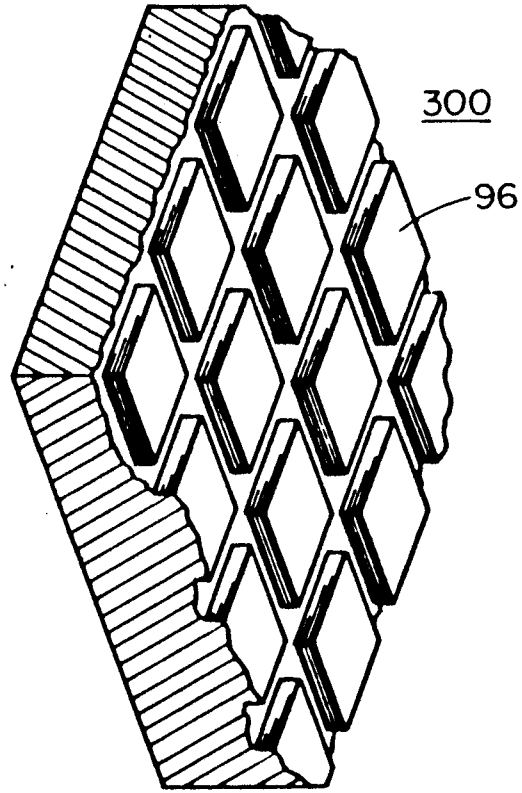
FIG. 8 is a perspective drawing of textured fluid bearing surface 300 which is affixed to tank 12 of FIG. 2.

FIG. 8 is a perspective drawing of textured fluid bearing surface 300 of tank 12. Textured surface 300 is textured by any known process, e.g., knurling, molded, EDM electro-discharged machined or applied. Knurls 96 are shown on surface 300. Texturing improves the flow of solution 75 between photosensitive material 80 and tank 12. This yields a bearing of fluid aiding photosensitive material transport through tank 12 and allows the gelatin on photosensitive material 80 to swell. It also allows for improved circulation of solution 75 and makes it easier for particulate matter to escape direct and damaging contact with photosensitive material 80.

Textured surface 300 provides space between tank 12 and space 10 to prevent particulate matter from scratching, abrading or pressure sensitizing photosensitive material 80.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for processing photosensitive materials, which comprises:

a tank having an inner textured surface, configured so that if processing solution flows along said textured surface, the processing solution will move along said textured surface to create a solution bearing layer for photosensitive material to be moved over said textured surface;

a rack having an outer textured surface, configured so that if processing solution flows along said textured surface, the processing solution will move along said textured surface to create a solution bearing layer for the photosensitive material to be moved over said textured surface, said rack has integral means to facilitate its insertion and removal from said tank and said rack and said tank are relatively dimensioned so that a small changing direction volume for holding photosensitive material and processing solution is formed between said rack and said tank;

means for circulating the processing solution through the small volume; and means coupled to said rack for moving the photosensitive material through the small volume, whereby when the photosensitive material changes direction, the fluid bearing created by the textured surfaces on said rack and said tank allows the photosensitive material to change direction unimpeded.

2. An apparatus for processing photosensitive materials, which comprises:

a tank having an inner textured surface, configured so that if processing solution flows along said textured surface, the processing solution will move along said textured surface to create a solution bearing layer for the photosensitive material to be moved over said textured surface;

a rack having an outer textured surface, configured so that if processing solution flows along said textured surface, the processing solution will move along said textured surface to create a solution bearing layer for the photosensitive material to be moved over said textured surface, said rack has integral means to facilitate its insertion and removal from said tank and said rack and said tank are relatively dimensioned so that a small volume for holding photosensitive material and processing solution is formed between said rack and said tank;

means for circulating the processing solution through the small volume; and means coupled to said rack for moving the photosensitive material through the small volume, whereby when particulate matter is in the processing solution, the textured surfaces of said rack and said tank provides a space for the particulate matter to prevent damaging the surface of the photosensitive material.

* * * * *